US005983664A

United States Patent [19]

Campbell et al.

[11] Patent Number: 5,983,664

[45] Date of Patent: Nov. 16, 1999

[54] HYDROCARBON GAS PROCESSING

[75] Inventors: Roy E. Campbell, deceased, late of Midland, by Wanda Campbell; John D. Wilkinson; Hank M. Hudson, both of Midland; Michael C. Pierce, Odessa, all of Tex.

[73] Assignee: Elcor Corporation, Dallas, Tex.

[21] Appl. No.: 09/054,802

[22] Filed: Apr. 3, 1998

Related U.S. Application Data

[60] Provisional application No. 60/043,132, Apr. 9, 1997.

[51] Int. Cl.[6] ..... F25J 3/00

[52] U.S. Cl. ..... 62/621; 62/935

[58] Field of Search ..... 62/621, 935

[56] References Cited

U.S. PATENT DOCUMENTS

| | | | |
|---|---|---|---|
| Re. 33,408 | 10/1990 | Khan et al. . | |
| 4,157,904 | 6/1979 | Campbell et al. . | |
| 4,171,964 | 10/1979 | Campbell et al. . | |
| 4,278,457 | 7/1981 | Cambpell et al. . | |
| 4,519,824 | 5/1985 | Huebel . | |
| 4,687,499 | 8/1987 | Aghili . | |
| 4,854,955 | 8/1989 | Campbell et al. . | |
| 4,869,740 | 9/1989 | Campbell et al. . | |
| 4,889,545 | 12/1989 | Campbell et al. . | |
| 5,275,005 | 1/1994 | Campbell et al. . | |
| 5,555,748 | 9/1996 | Campbell et al. . | |
| 5,566,554 | 10/1996 | Vijayaraghavan et al. | 62/621 |
| 5,568,737 | 10/1996 | Campbell et al. . | |
| 5,881,569 | 3/1999 | Campbell et al. | 62/621 |
| 5,890,377 | 4/1999 | Foglietta | 62/621 |
| 5,890,378 | 4/1999 | Rambo et al. | 62/621 |

*Primary Examiner*—Christopher B. Kilner
*Attorney, Agent, or Firm*—Baker & Botts LLP

[57] ABSTRACT

A process for the recovery of ethane, ethylene, propane, propylene and heavier hydrocarbon components from a hydrocarbon gas stream is disclosed. In recent years, the preferred method of separating a hydrocarbon gas stream generally includes supplying at least a portion of the gas stream to a work expansion device, then directing the work expanded stream to a distillation column at a mid-column feed point below an upper rectification section. The top column feed above the upper rectification section is typically a condensed and subcooled gaseous stream, frequently comprised of a gas stream that would otherwise feed the work expansion device. In the process disclosed, the work expanded stream is further cooled prior to feeding the distillation column at the mid-column feed point, so that a lesser volume of top column feed is required to maintain the column overhead temperature at a temperature whereby the major portion of the desired components is recovered.

7 Claims, 7 Drawing Sheets

HYDROCARBON GAS PROCESSING

The applicants' claim the benefits under Title 35 U.S.C. §119(e) of prior U.S. Provisional Application Ser. No. 60/043,132 which was filed on Apr. 9, 1997.

BACKGROUND OF THE INVENTION

This invention relates to a process for the separation of a gas containing hydrocarbons.

Ethylene, ethane, propylene, propane and/or heavier hydrocarbons can be recovered from a variety of gases, such as natural gas, refinery gas, and synthetic gas streams obtained from other hydrocarbon materials such as coal, crude oil, naphtha, oil shale, tar sands, and lignite. Natural gas usually has a major proportion of methane and ethane, i.e., methane and ethane together comprise at least 50 mole percent of the gas. The gas also contains relatively lesser amounts of heavier hydrocarbons such as propane, butanes, pentanes and the like, as well as hydrogen, nitrogen, carbon dioxide and other gases.

The present invention is generally concerned with the recovery of ethylene, ethane, propylene, propane and heavier hydrocarbons from such gas streams. A typical analysis of a gas stream to be processed in accordance with this invention would be, in approximate mole percent, 85.8% methane, 7.8% ethane and other $C_2$ components, 3.3% propane and other $C_3$ components, 0.5% iso-butane, 0.7% normal butane, 0.6% pentanes plus, with the balance made up of nitrogen and carbon dioxide. Sulfur containing gases are also sometimes present.

The historically cyclic fluctuations in the prices of both natural gas and its natural gas liquid (NGL) constituents have at times reduced the incremental value of ethane, ethylene, and heavier components as liquid products. This has resulted in a demand for processes that can provide more efficient recoveries of these products. Available processes for separating these materials include those based upon cooling and refrigeration of gas, oil absorption, and refrigerated oil absorption. Additionally, cryogenic processes have become popular because of the availability of economical equipment that produces power while simultaneously expanding and extracting heat from the gas being processed. Depending upon the pressure of the gas source, the richness (ethane, ethylene, and heavier hydrocarbons content) of the gas, and the desired end products, each of these processes or a combination thereof may be employed.

The cryogenic expansion process is now generally preferred for natural gas liquids recovery because it provides maximum simplicity with ease of start up, operating flexibility, good efficiency, safety, and good reliability. U.S. Pat. Nos. 4,157,904, 4,171,964, 4,278,457, 4,519,824, 4,687,499, 4,854,955, 4,869,740, 4,889,545, 5,275,005, 5,555,748, and 5,568,737, reissue U.S. Pat. No. 33,408, co-pending application Ser. No. 08/915,065, and co-pending application Ser. No. 60/044,569 describe relevant processes (although the description of the present invention in some cases is based on different processing conditions than those described in the cited U.S. Patents and applications).

In a typical cryogenic expansion recovery process, a feed gas stream under pressure is cooled by heat exchange with other streams of the process and/or external sources of refrigeration such as a propane compression-refrigeration system. As the gas is cooled, liquids may be condensed and collected in one or more separators as high-pressure liquids containing some of the desired $C_2$+ components. Depending on the richness of the gas and the amount of liquids formed, the high-pressure liquids may be expanded to a lower pressure and fractionated. The vaporization occurring during expansion of the liquids results in further cooling of the stream. Under some conditions, pre-cooling the high pressure liquids prior to the expansion may be desirable in order to further lower the temperature resulting from the expansion. The expanded stream, comprising a mixture of liquid and vapor, is fractionated in a distillation (demethanizer) column. In the column, the expansion cooled stream(s) is (are) distilled to separate residual methane, nitrogen, and other volatile gases as overhead vapor from the desired $C_2$ components, $C_3$ components, and heavier hydrocarbon components as bottom liquid product.

If the feed gas is not totally condensed (typically it is not), at least a portion of the vapor remaining from the partial condensation can be passed through a work expansion machine or engine, or an expansion valve, to a lower pressure at which additional liquids are condensed as a result of further cooling of the stream. The pressure after expansion is essentially the same as the pressure at which the distillation column is operated. The combined vapor-liquid phases resulting from the expansion are supplied as a feed to the column. In recent years, the preferred processes for hydrocarbon separation involve feeding this expanded vapor-liquid stream at a mid-column feed point, with an upper absorber section providing additional rectification of the vapor phase.

The source of the reflux stream for the upper rectification section is typically a portion of the above mentioned vapor remaining after partial condensation of the feed gas, but withdrawn prior to work expansion. An alternate source for the upper reflux stream may be provided by a recycled stream of residue gas supplied under pressure. Regardless of its source, this vapor stream is usually cooled to substantial condensation by heat exchange with other process streams, e.g., the cold fractionation tower overhead. Some or all of the high-pressure liquid resulting from partial condensation of the feed gas may be combined with this vapor stream prior to cooling. The resulting substantially condensed stream is then expanded through an appropriate expansion device, such as an expansion valve, to the pressure at which the demethanizer is operated. During expansion, a portion of the liquid will usually vaporize, resulting in cooling of the total stream. The flash expanded stream is then supplied as top feed to the demethanizer. Typically, the vapor portion of the expanded stream and the demethanizer overhead vapor combine in an upper separator section in the fractionation tower as residual methane product gas. Alternatively, the cooled and expanded stream may be supplied to a separator to provide vapor and liquid streams, so that thereafter the vapor is combined with the tower overhead and the liquid is supplied to the column as a top column feed.

In the ideal operation of such a separation process, the residue gas leaving the process will contain substantially all of the methane in the feed gas with essentially none of the heavier hydrocarbon components, and the bottoms fraction leaving the demethanizer will contain substantially all of the heavier components with essentially no methane or more volatile components. In practice, however, this ideal situation is not obtained for the reason that the top demethanizer liquid feed is not of a sufficient quantity to completely absorb the $C_2$ components and heavier hydrocarbon components contained in the rising vapors. This volume of liquid (reflux) is typically limited by heat exchange or compression (energy) requirements. In such a case, it may be desirable to reduce the richness or volume of said rising vapors in the tower, reducing the need for additional reflux. The present invention provides a means for achieving this objective, resulting in improved $C_2$+ recoveries for equivalent energy requirements, or reduced energy requirements for the same $C_2$+ recoveries.

In accordance with the present invention, it has been found that $C_2$ recoveries can be improved in excess of 5 percent over the prior art. Similarly, energy (compression) requirements can be reduced by as much as 10 percent compared to the prior art while maintaining the same $C_2$+ recovery level. The present invention, although applicable for leaner gas streams at lower pressures and warmer temperatures, is particularly advantageous when processing richer feed gases at pressures in the range of 600 to 1000 psia or higher under conditions requiring column overhead temperatures of −110° F. or colder.

For a better understanding of the present invention, reference is made to the following examples and drawings. Referring to the drawings:

FIG. 1 is a flow diagram of a cryogenic expansion natural gas processing plant of the prior art according to U.S. Pat. No. 4,278,457 (or U.S. Pat. No. 4,157,904 as shown by the dashed line);

FIG. 2 is a flow diagram of a cryogenic expansion natural gas processing plant of an alternative prior art system according to U.S. Pat. No. 4,687,499;

In the following explanation of the above figures, tables are provided summarizing flow rates calculated for representative process conditions. In the tables appearing herein, the values for flow rates (in pound moles per hour) have been rounded to the nearest whole number for convenience. The total stream rates shown in the tables include all non-hydrocarbon components and hence are generally larger than the sum of the stream flow rates for the hydrocarbon components. Temperatures indicated are approximate values rounded to the nearest degree. It should also be noted that the process design calculations performed for the purpose of comparing the processes depicted in the figures are based on the assumption of no heat leak from (or to) the surroundings to (or from) the process. The quality of commercially available insulating materials makes this a very reasonable assumption and one that is typically made by those skilled in the art.

DESCRIPTION OF THE PRIOR ART

Figure 1:
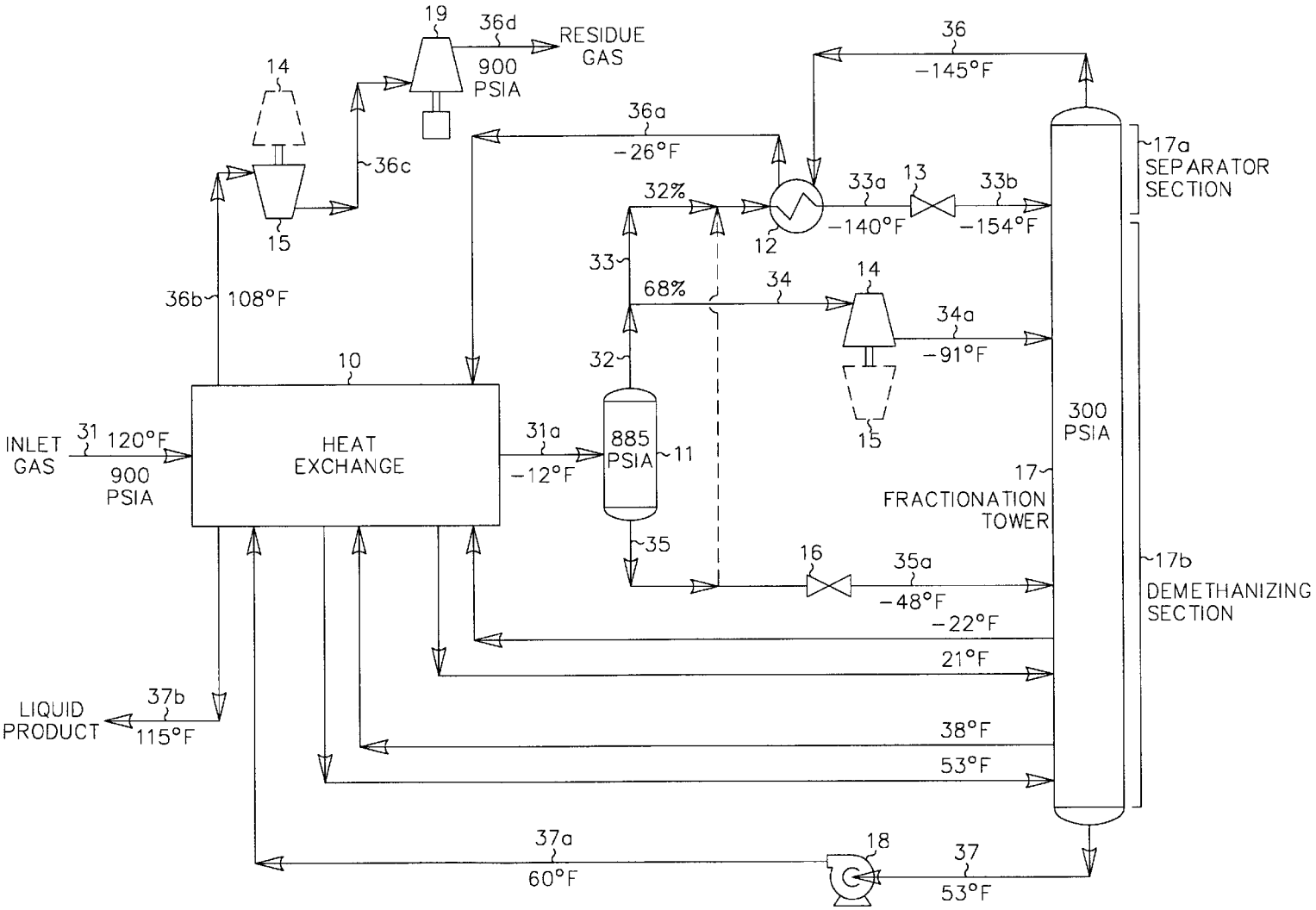
FIG. 1 (PRIOR ART)

Referring now to FIG. 1, in a simulation of the process according to U.S. Pat. No. 4,278,457, inlet gas enters the plant at 120° F. and 900 psia as stream 31. If the inlet gas contains a concentration of sulfur compounds which would prevent the product streams from meeting specifications, the sulfur compounds are removed by appropriate pretreatment of the feed gas (not illustrated). In addition, the feed stream is usually dehydrated to prevent hydrate (ice) formation under cryogenic conditions. Solid desiccant has typically been used for this purpose.

The feed stream 31 is cooled in exchanger 10 by heat exchange with cool residue gas at −26° F. (stream 36*a*), bottom liquid product at 60° F. (stream 37*a*), demethanizer reboiler liquids at 38° F., and demethanizer side reboiler liquids at −22° F. Note that in all cases exchanger 10 is representative of either a multitude of individual heat exchangers or a single multi-pass heat exchanger, or any combination thereof. (The decision as to whether to use more than one heat exchanger for the indicated cooling services will depend on a number of factors including, but not limited to, inlet gas flow rate, heat exchanger size, stream temperatures, etc.) The cooled stream 31*a* enters separator 11 at −12° F. and 885 psia where the vapor (stream 32) is separated from the condensed liquid (stream 35).

The vapor (stream 32) from separator 11 is divided into two streams, 33 and 34. Stream 33, containing about 32 percent of the total vapor, passes through heat exchanger 12 in heat exchange relation with the demethanizer overhead vapor stream 36 resulting in cooling and substantial condensation of the vapor stream. The substantially condensed stream 33*a* at −140° F. is then flash expanded through an appropriate expansion device, such as expansion valve 13, to the operating pressure (approximately 300 psia) of the fractionation tower 17. During expansion a portion of the stream is vaporized, resulting in cooling of the total stream. In the process illustrated in FIG. 1, the expanded stream 33*b* leaving expansion valve 13 reaches a temperature of −154° F. and is supplied to separator section 17*a* in the upper region of fractionation tower 17. The liquids separated therein become the top feed to demethanizing section 17*b*.

The remaining 68 percent of the vapor from separator 11 (stream 34) enters a work expansion machine 14 in which mechanical energy is extracted from this portion of the high pressure feed. The machine 14 expands the vapor substantially isentropically from a pressure of about 885 psia to a pressure of about 300 psia, with the work expansion cooling the expanded stream 34*a* to a temperature of approximately −91° F. The typical commercially available expanders are capable of recovering on the order of 80–85% of the work theoretically available in an ideal isentropic expansion. The work recovered is often used to drive a centrifugal compressor (such as item 15), that can be used to re-compress the residue gas (stream 36*b*), for example. The expanded and partially condensed stream 34*a* is supplied as feed to the distillation column at an intermediate point.

The separator liquid (stream 35) is likewise expanded to approximately 300 psia by expansion valve 16, cooling stream 35 to −48° F. (stream 35*a*) before it is supplied to the demethanizer in fractionation tower 17 at a lower mid-column feed point. An alternative routing for the separator liquid (stream 35) in accordance with U.S. Pat. No. 4,157,904 is indicated by a dashed line whereby at least a portion of the liquid is combined with vapor stream 33, thereby constituting a richer (higher $C_2$+ content) top column feed.

The demethanizer in fractionation tower 17 is a conventional distillation column containing a plurality of vertically spaced trays, one or more packed beds, or some combination of trays and packing. As is often the case in natural gas processing plants, the fractionation tower may consist of two sections. The upper section 17*a* is a separator wherein the partially vaporized top feed is divided into its respective vapor and liquid portions, and wherein the vapor rising from the lower distillation or demethanizing section 17*b* is combined with the vapor portion (if any) of the top feed to form the cold residue gas distillation stream 36 which exits the top of the tower. The lower, demethanizing section 17*b* contains the trays and/or packing and provides the necessary contact between the liquids falling downward and the vapors rising upward. The demethanizing section also includes reboilers which heat and vaporize a portion of the liquids flowing down the column to provide the stripping vapors which flow up the column.

The liquid product (stream 37) exits the bottom of the tower at 53° F., based on a typical specification of a methane to ethane ratio of 0.028:1 on a molar basis in the bottom product. The stream is pumped to approximately 805 psia (stream 37*a*) in pump 18. Stream 37*a*, now at about 60° F., is warmed to 115° F. (stream 37*b*) in exchanger 10 as it provides cooling to stream 31. (The discharge pressure of the pump is usually set by the ultimate destination of the liquid product. Generally the liquid product flows to storage and the pump discharge pressure is set so as to prevent any vaporization of stream 37*b* as it is warmed in exchanger 10.)

The residue gas (stream 36) passes countercurrently to the incoming feed gas in: (a) heat exchanger 12 where it is heated to −26° F. (stream 36*a*), and (b) heat exchanger 10 where it is heated to 108° F. (stream 36*b*). The residue gas is then re-compressed in two stages. The first stage is compressor 15 driven by expansion machine 14. The second stage is compressor 19 driven by a supplemental power source which compresses the residue gas to 900 psia (stream 36*d*), sufficient to meet line requirements (usually on the order of the inlet pressure).

A summary of stream flow rates and energy consumption for the process illustrated in FIG. 1 is set forth in the following table:

TABLE I (FIG. 1)
Stream Flow Summary-(Lb. Moles/Hr)

| Stream | Methane | Ethane | Propane | Butanes+ | Total |
|---|---|---|---|---|---|
| 31 | 23542 | 2144 | 898 | 491 | 27451 |
| 32 | 23011 | 1942 | 686 | 217 | 26222 |
| 35 | 531 | 202 | 212 | 274 | 1229 |
| 33 | 7271 | 614 | 217 | 69 | 8286 |
| 34 | 15740 | 1328 | 469 | 148 | 17936 |
| 36 | 23490 | 299 | 8 | 0 | 24129 |
| 37 | 52 | 1845 | 890 | 491 | 3322 |
| | Recoveries* | | | | |
| | Ethane | | | 86.07% | |
| | Propane | | | 99.09% | |
| | Butanes+ | | | 99.92% | |
| | Horsepower | | | | |
| | Residue Compression | | | 14,195 | |

*(Based on un-rounded flow rates)

The prior art illustrated in FIG. 1 is limited to the ethane recovery shown in Table I by the amount of substantially condensed feed gas which can be produced to serve as reflux for the upper rectification section of the demethanizer. The recovery of $C_2$ components and heavier hydrocarbon components can be improved up to a point either by increasing the amount of substantially condensed feed gas supplied as the top feed of the demethanizer, or by lowering the temperature of separator 11 to reduce the temperature of the work expanded feed gas and thereby reduce the temperature and quantity of vapor supplied to the mid-column feed point of the demethanizer that must be rectified. Changes of this type can only be accomplished by removing more energy from the feed gas, either by adding supplemental refrigeration to cool the feed gas further, or by lowering the operating pressure of the demethanizer to increase the energy recovered by work expansion machine 14. In either case, the utility (compression) requirements will increase inordinately while providing only marginal increases in $C_2$+ component recovery levels.

Figure 2:
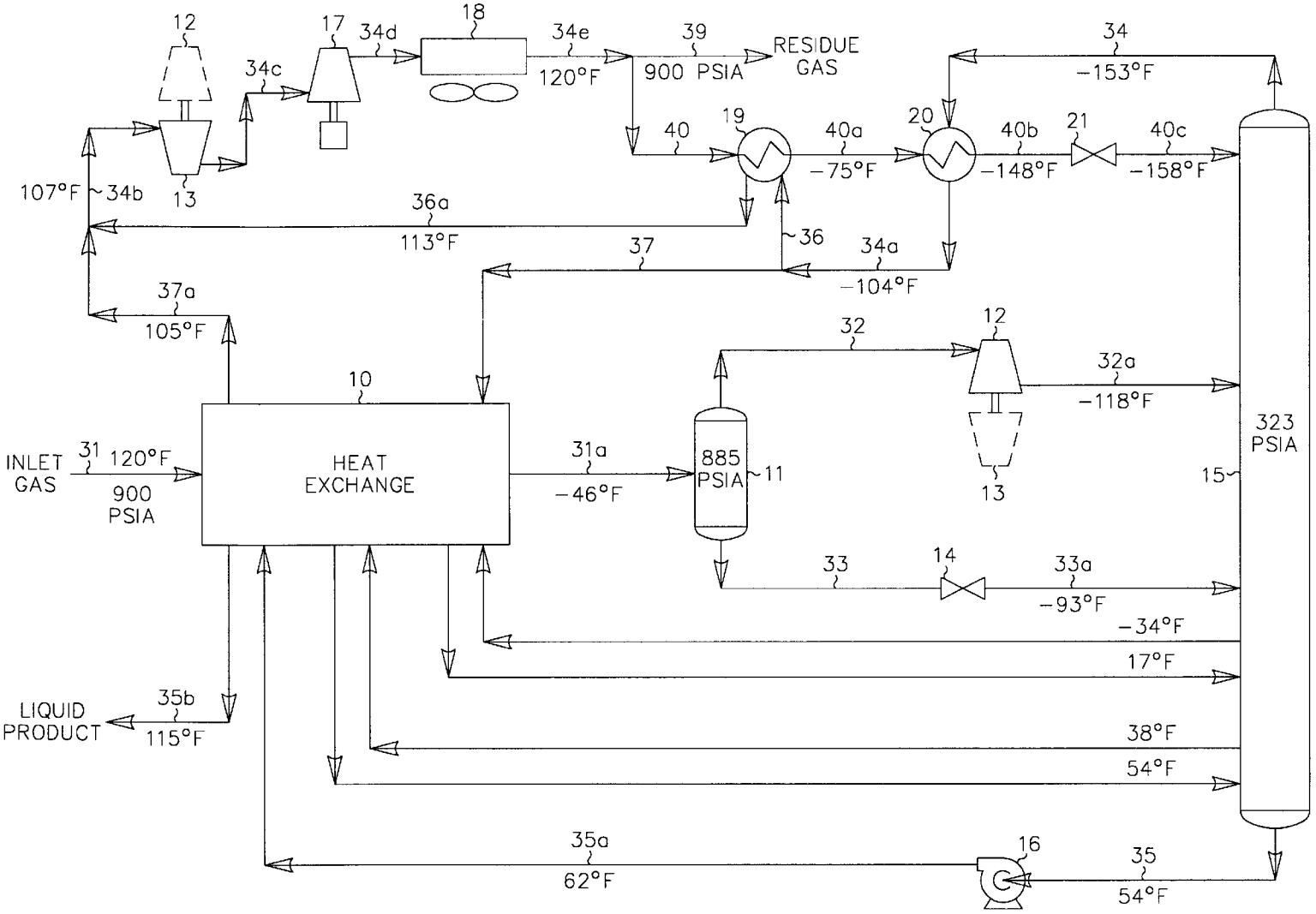
FIG. 2 (PRIOR ART)

One way to achieve higher ethane recovery in a case such as this (where the recovery is limited by the energy that can be removed from the feed gas) without lowering the demethanizer operating pressure is to substantially condense a portion of the re-compressed residue gas and recycle it to the demethanizer as its top (reflux) feed. In essence, this is a compression-refrigeration cycle for the demethanizer using the volatile residue gas as the working fluid. FIG. 2 represents such an alternative prior art process in accordance with U.S. Pat. No. 4,687,499 that recycles a portion of the residue gas product to provide a leaner top feed to the demethanizer. The process of FIG. 2 has been applied to the same feed gas composition and conditions as described above for FIG. 1. However, in the simulation of the process of FIG. 2 a recovery level has been selected that is not reasonably achievable with the process of FIG. 1.

In the simulation of this process, as in the simulation for the process of FIG. 1, operating conditions were selected to minimize energy consumption for a given recovery level. The feed stream 31 is cooled in exchanger 10 by heat exchange with cool residue gas at −104° F. (stream 37), bottom liquid product at 62° F. (stream 35*a*), demethanizer reboiler liquids at 38° F., and demethanizer side reboiler liquids at −34° F. The cooled stream 31*a* enters separator 11 at −46° F. and 885 psia where the vapor (stream 32) is separated from the condensed liquid (stream 33).

The vapor from separator 11 (stream 32) enters a work expansion machine 12 in which mechanical energy is extracted from this portion of the high pressure feed. The machine 12 expands the vapor substantially isentropically from a pressure of about 885 psia to the operating pressure of the demethanizer of about 323 psia, with the work expansion cooling the expanded stream 32*a* to a temperature of approximately −118° F. The expanded and partially condensed stream 32*a* is supplied as a feed to the distillation column at an intermediate point. The separator liquid (stream 33) is likewise expanded to 323 psia by expansion valve 14, cooling stream 33 to −93° F. (stream 33*a*) before it is supplied to the demethanizer in fractionation tower 15 at a lower mid-column feed point.

A portion of the high pressure residue gas (stream 40) is withdrawn from the main residue flow (stream 34*e*) to become the top distillation column feed. Recycle gas stream 40 passes through heat exchanger 19 in heat exchange relation with a portion of the cool residue gas (stream 36) where it is cooled to −75° F. (stream 40*a*). Cooled recycle stream 40*a* then passes through heat exchanger in heat exchange relation with the cold demethanizer overhead distillation vapor stream 34 resulting in further cooling and substantial condensation of the recycle stream. The further cooled stream 40*b* at −148° F. is then expanded through an appropriate expansion device, such as expansion valve 21. As the stream is expanded to the demethanizer operating pressure of 323 psia, it is cooled to a temperature of approximately −158° F. (stream 40*c*). The expanded stream 40*c* is supplied to the tower as the top feed.

The liquid product (stream 35) exits the bottom of tower at 54° F. This stream is pumped to approximately 805 psia (stream 35*a*) in pump 16. Stream 35*a*, now at 62° F., is warmed to 115° F. (stream 35*b*) in exchanger 10 as it provides cooling to stream 31.

The cold residue gas (stream 34) at a temperature of −153° F. passes countercurrently to the recycle gas stream in heat exchanger 20 where it is warmed to −104° F. (stream 34*a*). The warmed residue gas is then divided into two portions, streams 36 and 37. One portion, stream 36, passes countercurrently to the recycle stream 40 in heat exchanger 19 where it is heated to 113° F. (stream 36*a*). The other portion, stream 37, passes countercurrently to the incoming feed gas in heat exchanger 10 where it is heated to 105° F. (stream 37*a*). The two heated streams then recombine to form the warm residue stream 34*b* at 107° F. The recombined warm residue gas is then re-compressed in two stages. The first stage is compressor 13 driven by expansion machine 12. The second stage is compressor 17 driven by a supplemental power source which compresses the residue gas to 900 psia (stream 34*d*). After stream 34*d* is cooled to 120° F. (stream 34*e*) by heat exchanger 18, the recycle stream 40 is withdrawn and the residue gas product (stream 39) flows to the sales pipeline.

A summary of stream flow rates and energy consumption for the process illustrated in FIG. 2 is set forth in the following table:

TABLE II (FIG. 2)
Stream Flow Summary-(Lb. Moles/Hr)

| Stream | Methane | Ethane | Propane | Butanes+ | Total |
|---|---|---|---|---|---|
| 31 | 23542 | 2144 | 898 | 491 | 27451 |
| 32 | 21308 | 1479 | 393 | 90 | 23605 |
| 33 | 2234 | 665 | 505 | 401 | 3846 |
| 40 | 7687 | 25 | 0 | 0 | 7810 |
| 34 | 31171 | 102 | 0 | 0 | 31670 |
| 39 | 23484 | 77 | 0 | 0 | 23860 |
| 35 | 58 | 2067 | 898 | 491 | 3591 |
| | Recoveries* | | | | |
| | Ethane | | | 96.45% | |
| | Propane | | | 100.00% | |
| | Butanes+ | | | 100.00% | |
| | Horsepower | | | | |
| | Residue compression | | | 18,130 | |

*(Based on un-rounded flow rates)

Comparison of the recovery levels displayed in Tables I and II shows that the additional refrigeration in the FIG. 2 process created by recycling a portion of the column overhead stream provides a substantial improvement in liquids recovery. The FIG. 2 process improves ethane recovery from 86.07% to 96.45%, propane recovery from 99.09% to 100.00%, and butanes+ recovery from 99.92% to 100.00%. However, the horsepower (utility) requirement of the FIG. 2 process is substantially higher (by almost 28 percent) than that of the FIG. 1 process. This means that the liquid recovery efficiency of the FIG. 2 process is about 12 percent lower than the FIG. 1 process (in terms of ethane recovered per unit of horsepower expended).

DESCRIPTION OF THE INVENTION

EXAMPLE 1

Figure 3:
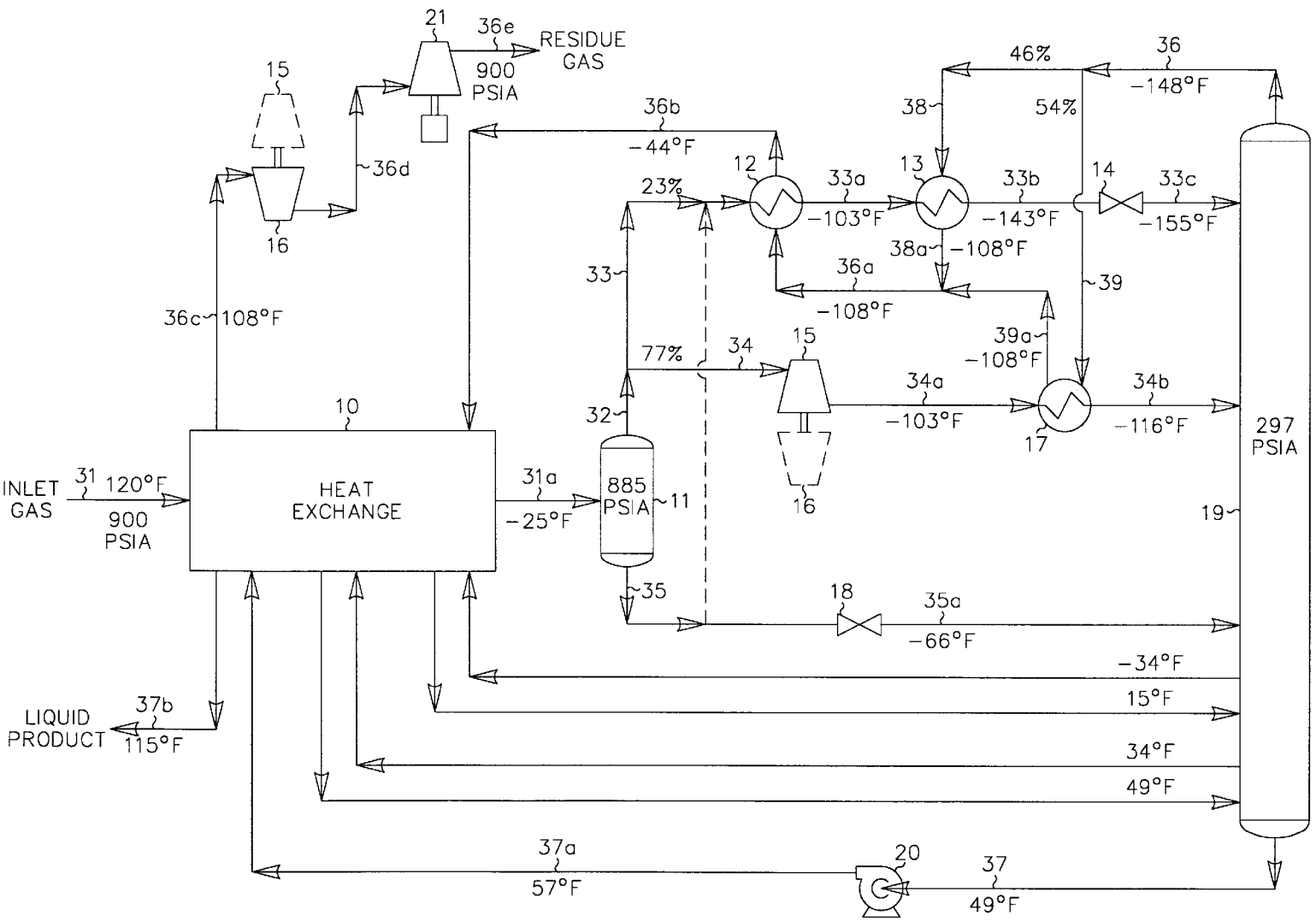
FIG. 3 is a flow diagram of a natural gas processing plant in accordance with the present invention.

FIG. 3 illustrates a flow diagram of a process in accordance with the present invention. The feed gas composition and conditions considered in the process presented in FIG. 3 are the same as those in FIG. 1. Accordingly, the FIG. 3 process can be compared with that of the FIG. 1 process to illustrate the advantages of the present invention.

In the simulation of the FIG. 3 process, inlet gas enters at 120° F. and a pressure of 900 psia as stream 31. The feed stream 31 is cooled in exchanger 10 by heat exchange with cool residue gas at −44° F. (stream 36*b*), bottom liquid product at 57° F. (stream 37*a*), demethanizer reboiler liquids at 34° F., and demethanizer side reboiler liquids at −34° F. The cooled stream 31*a* enters separator 11 at −25° F. and 885 psia where the vapor (stream 32) is separated from the condensed liquid (stream 35).

The vapor (stream 32) from separator 11 is divided into gaseous first and second streams, 33 and 34. Stream 33, containing about 23 percent of the total vapor, passes through heat exchanger 12 in heat exchange relation with the cool residue gas (stream 36*a*) where it is cooled to −103° F. (stream 33*a*). The partially cooled stream 33*a* then passes through heat exchanger 13 and is further cooled by heat exchange relation with a portion (stream 38) of the −148° F. cold distillation stream 36. The resulting substantially condensed stream 33*b* leaves exchanger 13 at −143° F. and is then flash expanded through an appropriate expansion device, such as expansion valve 14, to the operating pressure (approximately 297 psia) of fractionation tower 19. During expansion a portion of the stream is vaporized, resulting in cooling of the total stream. In the process illustrated in FIG. 3, the expanded stream 33*c* leaving expansion valve 14 reaches a temperature of −155° F. and is supplied to fractionation tower 19 as the top column feed. The vapor portion (if any) of stream 33*c* combines with the vapors rising from the top fractionation stage of the column to form distillation stream 36, which is withdrawn from an upper region of the tower.

Returning to the gaseous second stream 34, the remaining 77 percent of the vapor from separator 11 enters a work expansion machine 15 in which mechanical energy is extracted from this portion of the high pressure feed. The machine 15 expands the vapor substantially isentropically from a pressure of about 885 psia to a pressure of about 300 psia, with the work expansion cooling the expanded stream 34*a* to a temperature of approximately −103° F. The expanded and partially condensed stream 34*a* then passes through heat exchanger 17 in heat exchange relation with the remaining portion (stream 39) of cold distillation stream 36, resulting in further cooling of the work expanded stream 34*b* to a temperature of −116° F., which is thereafter supplied as feed to the distillation column at a mid-column feed point.

The condensed liquid (stream 35) from separator 11 is flash expanded through an appropriate expansion device, such as expansion valve 18, to the operating pressure (approximately 297 psia) of fractionation tower 19, cooling stream 35 to a temperature of −66° F. (stream 35*a*). The expanded stream 35*a* leaving expansion valve 18 is then supplied to fractionation tower 19 at a lower mid-column feed point.

The liquid product (stream 37) exits the bottom of tower 19 at 49° F. and is pumped to a pressure of approximately 805 psia (stream 37*a*) in demethanizer bottoms pump 20. The pumped liquid product is then warmed to 115° F. (stream 37*b*) in exchanger 10 as it provides cooling to inlet gas stream 31.

The cold distillation stream 36 at −148° F. from the upper section of the demethanizer is divided into two portions, streams 38 and 39. Stream 38 passes countercurrently to the cooled and partially condensed gaseous first stream 33*a* in heat exchanger 13 where it is warmed to −108° F. (stream 38*a*) as it provides cooling and substantial condensation of stream 33*a*. Similarly, stream 39 passes countercurrently to work expanded stream 34*a* in heat exchanger 17 where it is warmed to −108° F. (stream 39*a*) as it provides further cooling and additional condensation of stream 34*a*. The two partially warmed streams 38*a* and 39*a* then recombine as stream 36*a* at a temperature of −108° F. The recombined stream passes countercurrently to the gaseous first stream 33 in heat exchanger 12 where it is heated to −44° F. (stream 36*b*) as it provides cooling and partial condensation of stream 33.

The cool residue gas stream 36*b* passes countercurrently to the incoming feed gas stream 31 in heat exchanger 10 where it is heated to 108° F. (stream 36*c*) . The warm residue gas stream 36*c* is then re-compressed in two stages. The first stage is compressor 16 driven by expansion machine 15. The second stage is compressor 21 driven by a supplemental power source which compresses the residue gas (stream 36*d*) to sales line pressure of 900 psia (stream 36*e*).

A summary of stream flow rates and energy consumption for the process illustrated in FIG. 3 is set forth in the following table:

TABLE III (FIG. 3)
Stream Flow Summary-(Lb. Moles/Hr)

| Stream | Methane | Ethane | Propane | Butanes+ | Total |
|---|---|---|---|---|---|
| 31 | 23542 | 2144 | 898 | 494 | 27451 |
| 32 | 22632 | 1815 | 584 | 161 | 25551 |
| 35 | 910 | 329 | 314 | 330 | 1900 |
| 33 | 5284 | 424 | 136 | 38 | 5965 |
| 34 | 17348 | 1391 | 448 | 123 | 19586 |
| 36 | 23489 | 243 | 7 | 0 | 24050 |
| 37 | 53 | 1901 | 891 | 491 | 3401 |
| | Recoveries* | | | | |
| | Ethane | | | 88.66% | |
| | Propane | | | 99.28% | |
| | Butanes+ | | | 99.95% | |
| | Horsepower | | | | |
| | Residue Compression | | | 14,195 | |

*(Based on un-rounded flow rates)

Comparison of the recovery levels displayed in Tables I and III shows that the present invention in its simplest form improves ethane recovery from 86.07% to 88.66%, propane recovery from 99.09% to 99.28%, and butanes+ recovery from 99.92% to 99.95%. Comparison of Tables I and III further shows that the improvement in yields was not simply the result of increasing the horsepower (utility) requirements. To the contrary, when the present invention is employed as in Example 1, not only do the ethane, propane, and butanes+ recoveries increase over those of the prior art process, but liquid recovery efficiency also increases by 3.0 percent (in terms of ethane recovered per unit of horsepower expended).

A significant benefit of the process represented by FIG. 3 is an increase in the work available from the work expansion machine 15. By further cooling the work expanded stream 34*a* prior to feeding the column (stream 34*b*), it is possible to reduce the amount of demethanizer top reflux (stream 33) by 28 percent in the FIG. 3 process compared to the FIG. 1 process. In the process of FIG. 3, a reduction in the flow of stream 33 corresponds to an increase in the flow of stream 34 feeding work expansion machine 15, thereby increasing the heat removed from stream 34 and increasing the energy available to booster compressor 16. Such an increase in booster compressor horsepower allows a reduction in the fractionation tower operating pressure, providing improved product recoveries without increasing utility (compression) requirements.

EXAMPLE 2

Figure 4:
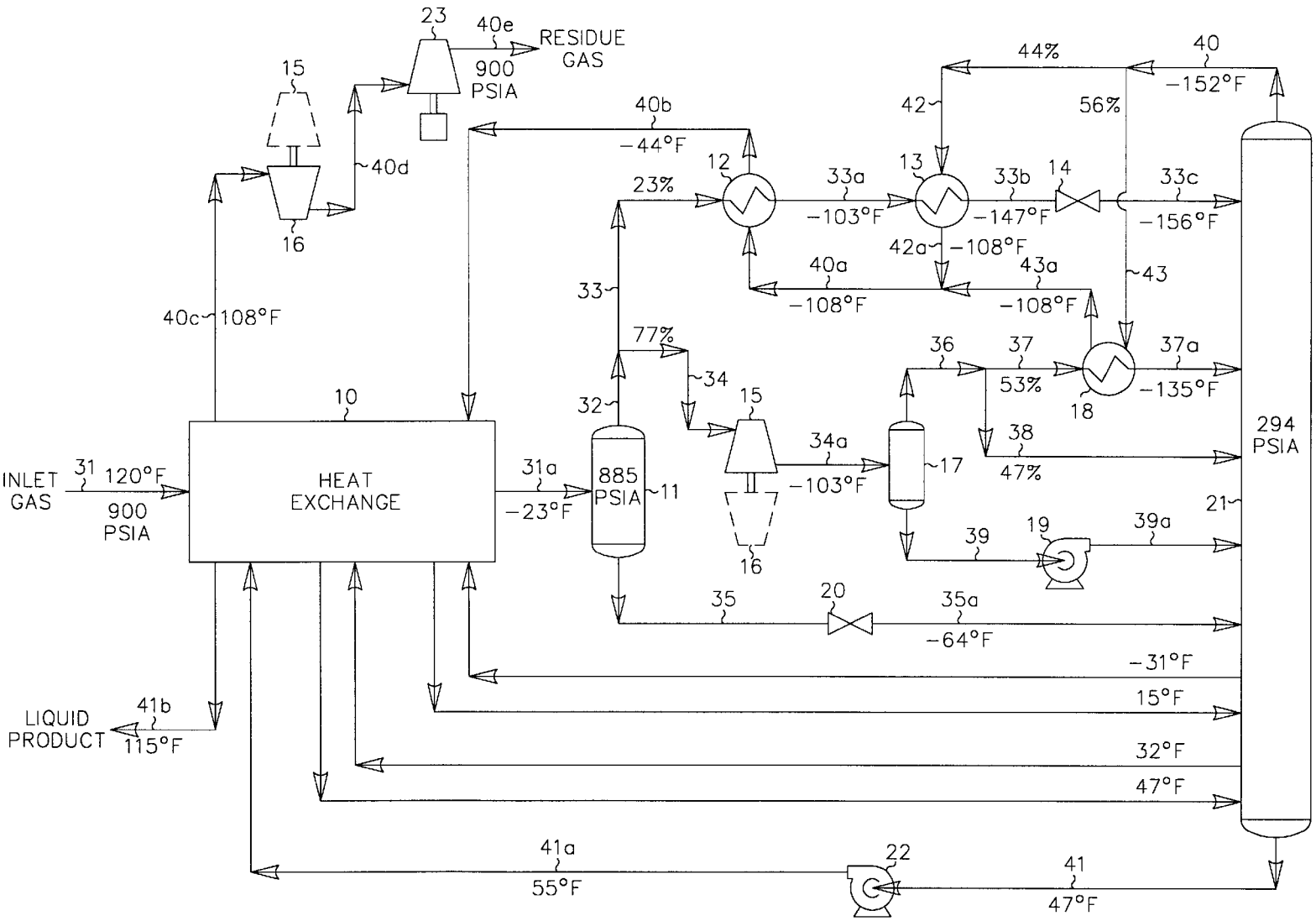
FIGS. 4 and 5 are flow diagrams illustrating alternative means of application of the present invention to a natural gas stream.

FIG. 4 illustrates a flow diagram in accordance with the preferred embodiment of the present invention when applied to the prior art process depicted in FIG. 1. In the simulation of the FIG. 4 process, the inlet gas cooling and separation scheme is essentially the same as that used in FIG. 3. The difference lies in the disposition of the work expansion machine 15 discharge (stream 34*a*). Rather than cooling the entire mixed-phase stream prior to feeding the fractionation tower at a mid-column feed point, it is preferable to cool only a portion of the vapor. This further cooled stream then feeds the demethanizer at an upper mid-column feed point, above the remaining vapor portion and the liquid portion. The feed gas composition and conditions considered in the process presented in FIG. 4 are the same as those in FIGS. 1 and 3. Accordingly, FIG. 4 can be compared with the FIG. 1 process to illustrate the advantages of the present invention, and can likewise be compared to the embodiment displayed in FIG. 3.

In the simulation of the FIG. 4 process, inlet gas enters at 120° F. and 900 psia as stream 31 and is cooled in exchanger 10 by heat exchange with cool residue gas at −44° F. (stream 40*b*), bottom liquid product at 55° F. (stream 41*a*), demethanizer reboiler liquids at 32° F., and demethanizer side reboiler liquids at −31° F. The cooled stream 31*a* enters separator 11 at −23° F. and 885 psia where the vapor (stream 32) is separated from the condensed liquid (stream 35).

The vapor from separator 11 (stream 32) is divided into gaseous first and second streams, 33 and 34. Stream 33, containing about 23 percent of the total vapor, passes through heat exchanger 12 in heat exchange relation with the cool residue gas (stream 40*a*) where it is cooled to −103° F. (stream 33*a*). The partially cooled stream 33*a* then passes through exchanger 13 and is further cooled by heat exchange relation with a portion (stream 42) of the −152° F. cold distillation stream 40. The resulting substantially condensed stream 33*b* leaves exchanger 13 at −147° F. and is then flash expanded through an appropriate expansion device, such as expansion valve 14, to the operating pressure (approximately 294 psia) of fractionation tower 21. The expanded stream 33*c* leaving expansion valve 14 reaches a temperature of −156° F. and is supplied to fractionation tower 21 as the top column feed.

Returning to the gaseous second stream 34, the remaining 77 percent of the vapor from separator 11 enters a work expansion machine 15 in which mechanical energy is extracted from this portion of the high pressure feed. The machine 15 expands the vapor substantially isentropically from a pressure of about 885 psia to a pressure of about 297 psia, with the work expansion cooling the expanded stream 34*a* to a temperature of approximately −103° F. The expanded and partially condensed stream 34*a* then enters separator 17 where the vapor (stream 36) is separated from the condensed liquid (stream 39).

The vapor (stream 36) from separator 17 is divided into two streams, 37 and 38. Stream 37, containing about 53 percent of the total vapor, passes through heat exchanger 18 in heat exchange relation with the remaining portion (stream 43) of the cold distillation stream 40, resulting in cooling and partial condensation of stream 37*a*, which is thereafter supplied to the distillation column at an upper mid-column feed point.

The remaining 47 percent of the vapor from separator 17 (stream 38) is fed to the distillation column at a second upper mid-column feed point. The condensed liquid (stream 39) from separator 17 is typically pumped to overcome hydrostatic head by pump 19 prior to feeding the distillation column at a third upper mid-column feed point. The decision as to whether to include a pump for the liquid from separator 17 will depend on the acceptable back-pressure on the expansion machine. If a pump is not included, the discharge pressure of the expansion machine must be increased by an amount equal to the hydrostatic head of the column of liquid (stream 39), less the pressure drop of the first vapor portion (stream 37) through exchanger 18. Depending on the particular conditions, an alternate solution may consist of mixing the second vapor portion (stream 38) with the condensed liquids (stream 39), thereby reducing the hydrostatic head.

The condensed liquid (stream 35) from separator 11 is flash expanded to the operating pressure (approximately 294 psia) of fractionation tower 21 through an appropriate expansion device, such as expansion valve 20, cooling stream 35 to a temperature of −64° F. (stream 35*a*). The expanded stream 35*a* leaving expansion valve 20 is then supplied to fractionation tower 21 at a lower mid-column feed point.

The liquid product (stream 41) exits the bottom of tower 21 at 47° F. and is pumped to a pressure of approximately 805 psia (stream 41*a*) in demethanizer bottoms pump 22. The pumped liquid product is then warmed to 115° F. (stream 41*b*) in exchanger 10 as it provides cooling to inlet gas stream 31.

The cold distillation stream 40 at −152° F. from the upper section of the demethanizer is divided into two portions, streams 42 and 43. Stream 42 passes countercurrently to the cooled and partially condensed gaseous first stream 33*a* in heat exchanger 13 where it is warmed to −108° F. (stream 42*a*) as it provides cooling and substantial condensation of stream 33*a*. Similarly, stream 43 passes countercurrently to the first portion of vapor from separator 17 (stream 37) in heat exchanger 18 where it is warmed to −108° F. (stream 43*a*) as it provides cooling and partial condensation of stream 37. The two partially warmed streams 42*a* and 43*a* then recombine as stream 40*a* at a temperature of −108° F. The recombined stream passes countercurrently to the gaseous first stream 33 in heat exchanger 12 where it is heated to −44° F. (stream 40*b*) as it provides cooling and partial condensation of stream 33.

The cool residue gas stream 40*b* passes countercurrently to the incoming feed gas stream 31 in heat exchanger 10 where it is heated to 108° F. (stream 40*c*). The warm residue gas stream 40*c* is then re-compressed in two stages. The first stage is compressor 16 driven by expansion machine 15. The second stage is compressor 23 driven by a supplemental power source which compresses the residue gas (stream 40*d*) to sales line pressure of 900 psia (stream 40*e*).

A summary of stream flow rates and energy consumption for the process illustrated in FIG. 4 is set forth in the following table:

TABLE IV (FIG. 4)
Stream Flow Summary-(Lb. Moles/Hr)

| Stream | Methane | Ethane | Propane | Butanes+ | Total |
|---|---|---|---|---|---|
| 31 | 23542 | 2144 | 898 | 491 | 27451 |
| 32 | 22675 | 1829 | 594 | 166 | 25624 |
| 35 | 867 | 315 | 304 | 325 | 1827 |
| 33 | 5177 | 418 | 136 | 38 | 5850 |
| 34 | 17498 | 1411 | 458 | 128 | 19774 |
| 36 | 16896 | 905 | 89 | 5 | 18154 |
| 39 | 602 | 506 | 369 | 123 | 1620 |
| 37 | 8935 | 479 | 47 | 3 | 9600 |
| 38 | 7961 | 426 | 42 | 2 | 8554 |
| 40 | 23487 | 160 | 6 | 0 | 23962 |
| 41 | 55 | 1984 | 892 | 491 | 3489 |

TABLE IV-continued (FIG. 4)
Stream Flow Summary-(Lb. Moles/Hr)

| | |
|---|---|
| Recoveries* | |
| Ethane | 92.53% |
| Propane | 99.40% |
| Butanes+ | 99.95% |
| Horsepower | |
| Residue Compression | 14,195 |

*(Based on un-rounded flow rates)

A comparison of Tables III and IV shows that preferred embodiment of the present invention (FIG. 4) is capable of achieving significantly higher product recoveries than the simpler embodiment of FIG. 3. In addition, comparison of Tables I and IV that, compared to the prior art, the present invention improves ethane recovery from 86.07% to 92.53%, propane recovery 99.09% to 99.40%, and butanes+ recovery from 99.92% to 99.95%. Comparison of Tables I and IV further shows that the improvement in yields was achieved using equivalent horsepower (utility) requirements. When the present invention is employed as in Example 2, not only do the product recoveries increase over those of the prior art process, but liquid recovery efficiency also increases by 7.5 percent (in terms of ethane recovered per unit of horsepower expended).

As with the process of FIG. 3, a significant portion of the benefit achieved by the preferred embodiment of FIG. 4 is derived from a reduction in top column reflux, corresponding to an increase in booster compressor horsepower and lower fractionation tower operating pressure. However, in the preferred embodiment, only that portion of the vapor leaving work expansion machine 15 (stream 37) that can be effectively cooled using the available portion of cold distillation tower overhead (stream 43) is routed through exchanger 18. Upon being supplied to the tower at the first upper mid-column feed point, the condensed liquids resulting from cooling of this first vapor portion of the work expanded stream then act as additional reflux to the vapors rising up the distillation column. In this manner, the vapor requiring rectification by the top reflux stream is not only reduced in quantity, but is also leaner in composition. The result is increased $C_2$+ component recoveries for the FIG. 4 process while using essentially the same amount of top reflux as the FIG. 3 embodiment of the present invention.

EXAMPLE 3

Figure 5:
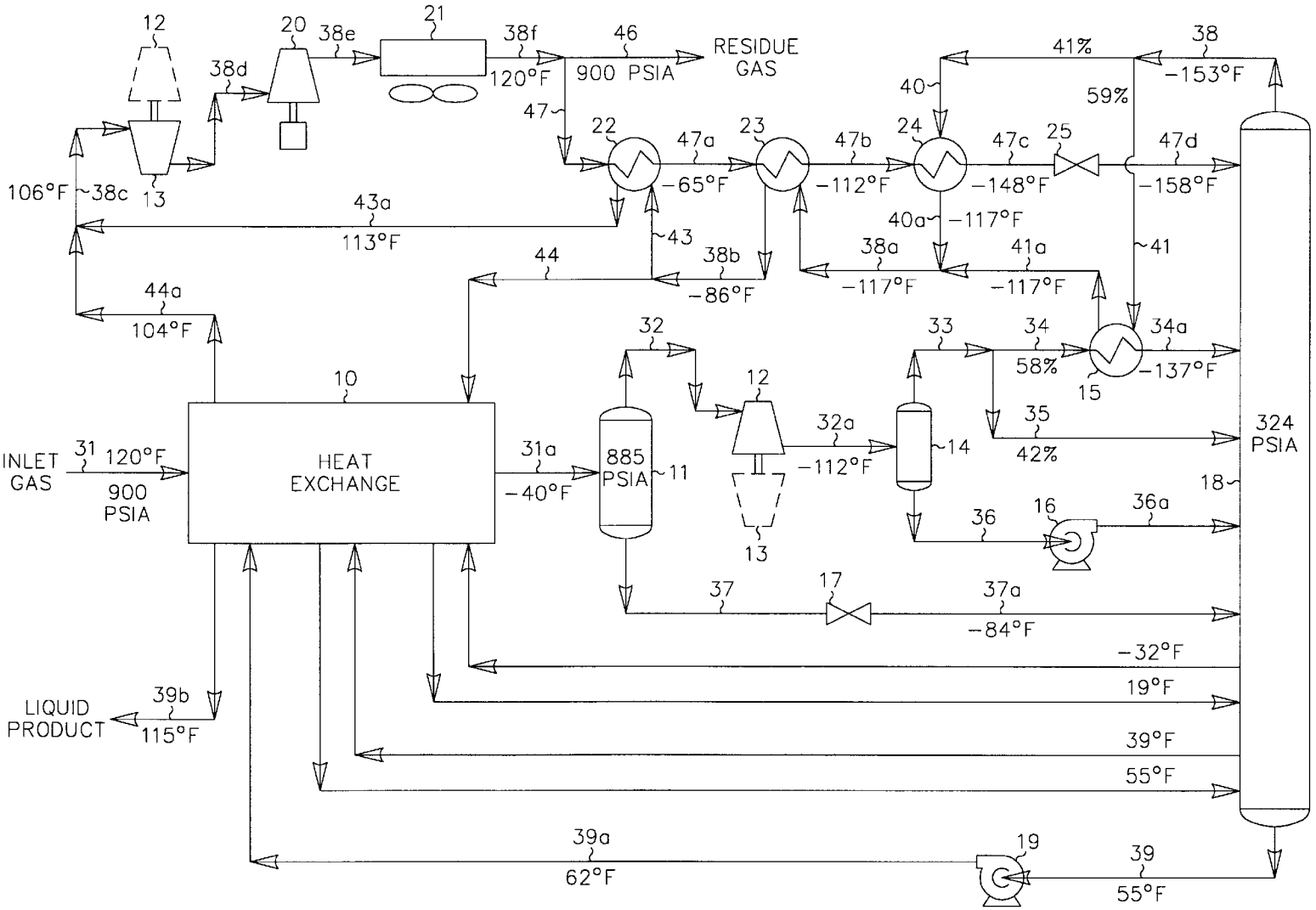

FIG. 5 illustrates a flow diagram in accordance with the preferred embodiment of the present invention when applied to the prior art process depicted in FIG. 2. In the simulation of the FIG. 5 process, the inlet gas cooling and separation scheme is essentially the same as that used in FIG. 2. The difference lies in the disposition of the work expansion machine 12 discharge (stream 32*a*). In accordance with the preferred embodiment of the present invention, expanded and partially condensed stream 32*a* enters separator 14 where the vapor (stream 33) is separated from the condensed liquid (stream 36).

The vapor (stream 33) from separator 14 is divided into two streams, 34 and 35. Stream 34, containing about 58 percent of the total vapor, passes through heat exchanger 15 in heat exchange relation with a portion (stream 41) of cold distillation stream 38, resulting in further cooling and partial condensation (stream 34*a*). The further cooled and partially condensed stream 34*a* is then supplied to the distillation column at an upper mid-column feed point.

The remaining 42 percent of the vapor from separator 14 (stream 35) is fed to the distillation column at a second upper mid-column feed point. The condensed liquid (stream 36) from separator 14 is pumped in pump 16 prior to feeding the distillation column at a third upper mid-column feed point. As in the process of FIG. 2, the source of the top column feed (reflux) is compressed warm residue gas that has been cooled, substantially condensed, and flashed to the operating pressure of the demethanizer.

A summary of stream flow rates and energy consumption for the process illustrated in FIG. 5 is set forth in the following table:

TABLE V (FIG. 5)
Stream Flow Summary-(Lb. Moles/Hr)

| Stream | Methane | Ethane | Propane | Butanes+ | Total |
|---|---|---|---|---|---|
| 31 | 23542 | 2144 | 898 | 491 | 27451 |
| 32 | 21822 | 1593 | 447 | 107 | 24314 |
| 37 | 1720 | 551 | 451 | 384 | 3137 |
| 33 | 20712 | 870 | 63 | 3 | 21961 |
| 36 | 1110 | 723 | 384 | 104 | 2353 |
| 34 | 12013 | 505 | 37 | 2 | 12737 |
| 35 | 8699 | 365 | 26 | 1 | 9224 |
| 47 | 5762 | 19 | 0 | 0 | 5856 |
| 38 | 29246 | 95 | 0 | 0 | 29724 |
| 46 | 23484 | 76 | 0 | 0 | 23868 |
| 39 | 58 | 2068 | 898 | 491 | 3583 |
| | Recoveries* | | | | |
| | Ethane | | | 96.45% | |
| | Propane | | | 100.00% | |
| | Butanes+ | | | 100.00% | |
| | Horsepower | | | | |
| | Residue Compression | | | 16,395 | |

*(Based on un-rounded flow rates)

Contrary to the comparisons of Tables I, III, and IV, the stimulation of FIG. 5 has been presented such that the recovery levels are substantially constant, so that the benefit of the present invention manifests itself as a reduction in utility (horsepower) requirements. Comparison of Tables II and V shows that the prior art process of FIG. 2 essentially matches the $C_2$+ recovery levels of the present invention. However, the FIG. 2 process does so at the expense of greatly increased horsepower (utility) consumption. The present invention achieves the same recovery levels using only 90 percent of the external power required by the FIG. 2 prior art process.

The reduction in compression horsepower for the FIG. 5 process stems from the top reflux feed for the FIG. 5 process (stream 47 in Table V) being 25 percent less than the top reflux feed for the FIG. 2 process (stream 40 in Table II). The cooling and partial condensation of a portion of the vapor phase leaving the work expansion machine results in additional liquids being supplied to the fractionation tower at the upper mid-column feed position, whereupon these liquids act like reflux on the vapor rising up the tower. This in turn reduces the amount of vapor to be rectified by the top reflux stream (and also creates a leaner vapor composition), allowing the corresponding reduction in the amount of top reflux feed required to achieve the desired $C_2$+ component recovery level.

Other Embodiments

One skilled in the art will recognize that the present invention gains much of its benefit by providing additional cooling to the mid-column feed or feeds, which typically comprise the majority of the vapor requiring rectification in the column. With this additional cooling, less reflux must be supplied to the upper section of the column, thereby reducing utility requirements for a given product recovery level, or improving product recovery levels for a given utility consumption, or some combination thereof. Therefore, the present invention is generally applicable to any process dependent on an upper reflux section consisting of any number of feed streams produced by substantially condensing a portion of the feed gas or residue gas and supplying the resulting reflux stream(s) to the column above the feed point(s) of the majority of the vapor to be rectified.

In accordance with this invention, the cooling of at least a portion of the work expanded stream may be accomplished in several ways. In the process of FIG. 3 the entire work expanded stream is cooled, while in the processes of FIGS. 4 and 5 only a portion of the vapor phase of the work expanded stream is cooled. However, this cooling as described in the present invention may be applied to any portion of the work expanded stream, such as the entire vapor stream, the condensed liquid stream, or any combination of the vapor and liquid.

Figure 6:
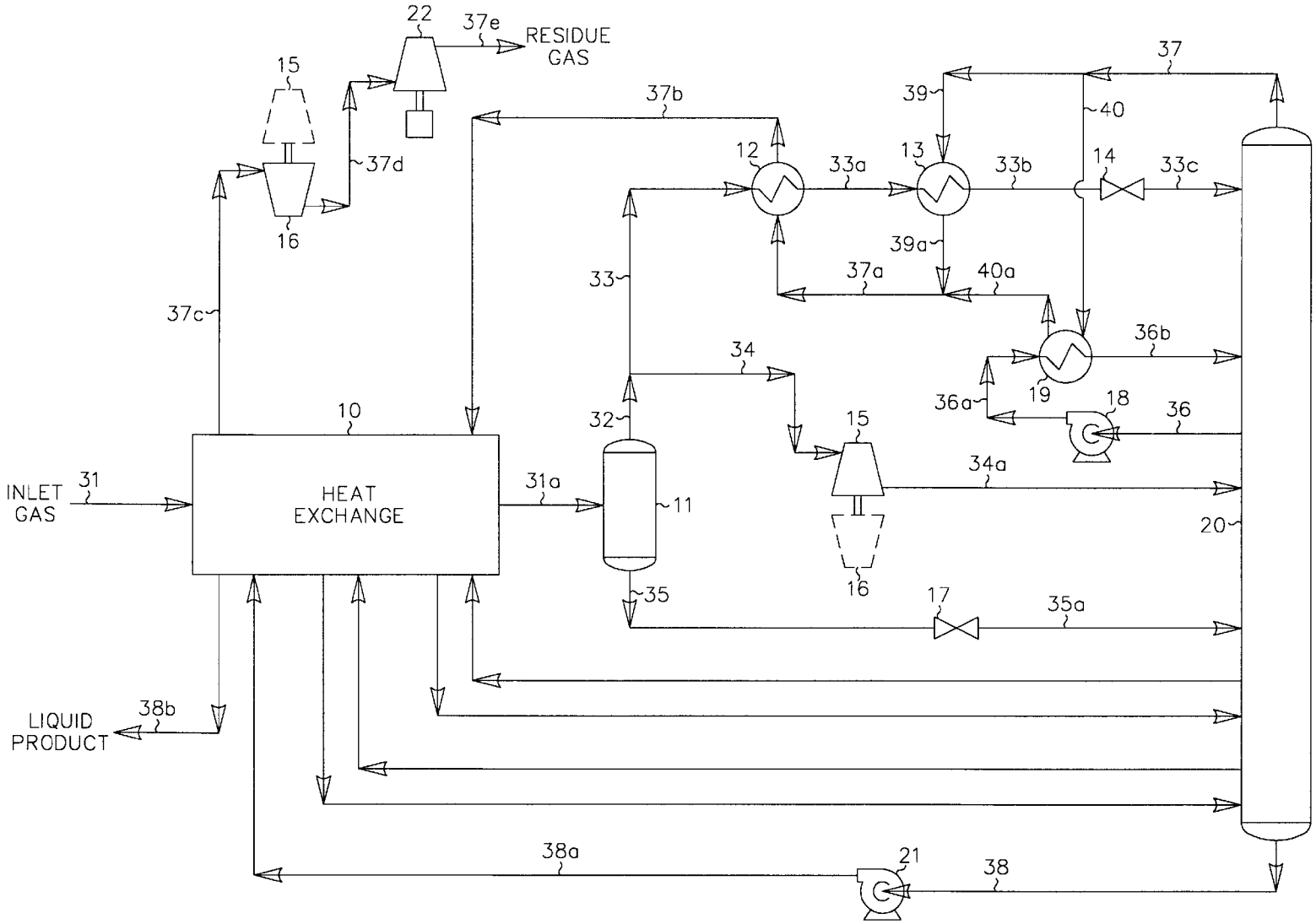
FIGS. 6 and 7 are flow diagrams illustrating alternative embodiments of the present invention.

This cooling of at least a portion of the mid-column feed(s) may be effectively carried out in any number of alternate process configurations. One such alternate method of cooling is presented in FIG. 6. In the process of FIG. 6, a portion of the demethanizer liquid is withdrawn from the distillation column as stream 36. After being pumped in liquid circulation pump 18, stream 36*a* is subcooled in exchanger 19 in heat exchange relation with a portion (stream 40) of the cold distillation stream 37. Subcooled stream 36*b* is returned to the column at a mid-column feed point above the point at which it was withdrawn. In this manner, low temperature cooling duty available in the demethanizer overhead vapor stream is transferred indirectly (via the side liquid stream) to the vapor phase of the work expanded stream rising up the fractionation tower.

Although the process configuration of FIG. 6 appears significantly different from the processes of FIGS. 3, 4, and 5, the benefits observed arise from substantially identical process conditions. One skilled in the art will recognize that any such method of removing a sufficient amount of duty from the majority of the column vapors will provide similar results. Other examples include, but are not limited to, cooling and return of a distillation column vapor side draw and cooling of the column vapors by use of process equipment such as an internal heat exchanger or dephlegmator. The selection of a method for providing cooling will depend on a number of factors including, but not limited to, inlet gas composition and conditions, plant size, equipment availability and cost, etc.

Figure 7:
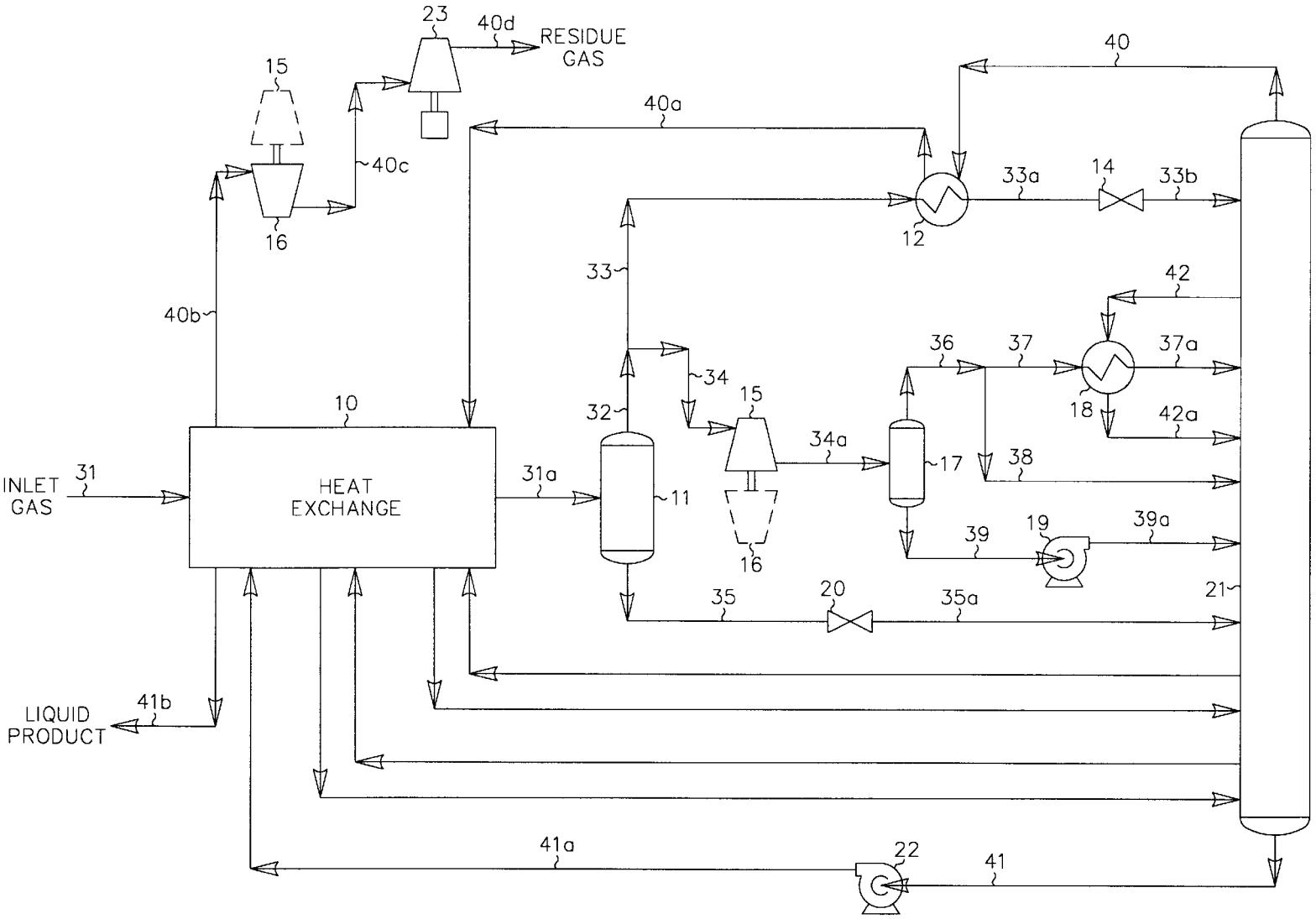

In addition to providing cooling by any number of different process methods as described above, it will be recognized that this cooling can be provided by a number of different sources. In the processes of FIGS. 3 through 6, the cooling has been provided by a portion of the distillation column overhead vapor stream. However, any such stream at a temperature colder than the process stream being cooled may be utilized. For instance, as shown in flow diagram FIG. 7, a portion of the fractionation tower liquids (stream 42) could be withdrawn from substantially the same region of the distillation column as the work expanded feed. After cooling at least a portion (stream 37) of the work expanded stream, the partially vaporized liquids (stream 42*a*) could then be returned to the distillation column at a point below one or more of the work expanded feed(s). Other potential sources of cooling include, but are not limited to, flashed high pressure separator liquids and mechanical refrigeration systems. The selection of a source of cooling will depend on a number of factors including, but not limited to, inlet gas composition and conditions, plant size, heat exchanger size, potential cooling source temperature, etc.

One skilled in the art will also recognize that any combination of the above cooling sources or methods of cooling may be employed in combination to achieve the desired benefit. For example, a first portion of the vapor in the work expanded stream may be cooled by distillation column overhead vapor, while a second portion may be simultaneously cooled by fractionation column liquids. A second scenario could involve partial cooling of a mid-column feed with one source of cooling, with further cooling being provided by a second source of cooling.

In accordance with this invention, the use of external refrigeration to supplement the cooling available to the inlet gas from other process streams may be employed, particularly in the case of an inlet gas richer than that used in Example 1. The use and distribution of demethanizer liquids for process heat exchange, and the particular arrangement of heat exchangers for inlet gas cooling must be evaluated for each particular application, as well as the choice of process streams for specific heat exchange services.

The high pressure liquid in FIGS. 3, 4, 6, and 7 (stream 35) need not be expanded and fed to the lower mid-column feed point on the distillation column. Alternatively, this liquid stream (or a portion thereof) may be combined with the portion of the separator vapor (stream 33) flowing to heat exchanger 12. (This is shown by the dashed line in FIG. 3.) The liquid stream may also be used for inlet gas cooling or other heat exchange service before or after the expansion step prior to flowing to the demethanizer.

It will also be recognized that the relative amount of feed found in each branch of the column feed streams will depend on several factors, including gas pressure, feed gas composition, the amount of heat which can economically be extracted from the feed and the quantity of horsepower available. More feed to the top of the column may increase recovery while decreasing power recovered from the expansion machine thereby increasing the recompression horsepower requirements. Increasing feed lower in the column reduces the horsepower consumption but may also reduce product recovery. The mid-column feed positions depicted in FIGS. 3 through 7 are the preferred feed locations for the process operating conditions described. However, the relative locations of the mid-column feeds may vary depending on inlet composition or other factors such as desired recovery levels and amount of liquid formed during inlet gas cooling. Moreover, two or more of the feed streams, or portions thereof, may be combined depending on the relative temperatures and quantities of individual streams, and the combined stream then fed to a mid-column feed position. FIGS. 3 through 7 are the preferred embodiments for the compositions and pressure conditions shown. Although individual stream expansion is depicted in particular expansion devices, alternative expansion means may be employed where appropriate. For example, conditions may warrant work expansion of the substantially condensed portion of the feed stream (33*b* in FIGS. 3, 4, and 6, and 33*a* in FIG. 7) or the substantially condensed recycle stream (47*c* in FIG. 5).

While there have been described what are believed to be preferred embodiments of the invention, those skilled in the art will recognize that other and further modifications may be made thereto, e.g. to adapt the invention to various conditions, types of feed, or other requirements, without departing from the spirit of the present invention as defined by the following claims.

We claim:

1. In a process for the separation of a gas stream containing methane, $C_2$ components, $C_3$ components and heavier hydrocarbon components into a volatile residue gas fraction containing a major portion of said methane and a relatively less volatile fraction containing a major portion of said $C_2$ components, $C_3$ components and heavier hydrocarbon components, in which process (a) said gas stream is treated in one or more heat exchange steps and at least one division step to produce at least a first stream that has been cooled under pressure to condense substantially all of it, and at least a second stream that has been cooled under pressure;

(b) said substantially condensed first stream is expanded to a lower pressure whereby it is further cooled, and thereafter supplied to a fractionation tower at a top feed point;

(c) said cooled second stream is expanded to said lower pressure, and thereafter supplied to said fractionation tower at a mid-column feed point; and (d) said cooled expanded first stream and said expanded second stream are fractionated at said lower pressure whereby the components of said relatively less volatile fraction are recovered;

the improvement wherein (1) at least a portion of said expanded second stream is further cooled before being supplied to said fractionation tower at said mid-column feed point; and (2) the quantities and temperatures of said feed streams to said fractionation tower are effective to maintain the overhead temperature of said fractionation tower at a temperature whereby the major portions of the components in said relatively less volatile fraction are recovered.

2. In a process for the separation of a gas stream containing methane, $C_2$ components, $C_3$ components and heavier hydrocarbon components into a volatile residue gas fraction containing a major portion of said methane and a relatively less volatile fraction containing a major portion of said $C_2$ components, $C_3$ components and heavier hydrocarbon components, in which process (a) said volatile residue gas fraction is re-compressed and a portion is withdrawn to form a compressed first stream;

(b) said compressed first stream is cooled under pressure to condense substantially all of it;

(c) said substantially condensed first stream is expanded to a lower pressure whereby it is further cooled, and thereafter supplied to a fractionation tower at a top feed point;

(d) said gas stream is treated in one or more heat exchange steps to produce at least a second stream that has been cooled under pressure;

(e) said cooled second stream is expanded to said lower pressure, and thereafter supplied to said fractionation tower at a mid-column feed point; and (f) said cooled expanded first stream and said expanded second stream are fractionated at said lower pressure whereby the components of said relatively less volatile fraction are recovered;

the improvement wherein (1) at least a portion of said expanded second stream is further cooled before being supplied to said fractionation tower at said mid-column feed point; and (2) the quantities and temperatures of said feed streams to said fractionation tower are effective to maintain the overhead temperature of said fractionation tower at a temperature whereby the major portions of the components in said relatively less volatile fraction are recovered.

3. The improvement according to claims 1 or 2 wherein at least a portion of said volatile residue gas fraction is directed in heat exchange relation with at least a portion of said expanded second stream to supply said further cooling thereto.

4. The improvement according to claims 1 or 2 wherein a liquid distillation stream is withdrawn from said fractionation tower in substantially the same region of said fractionation tower as said mid-column feed point of said further cooled second stream, whereupon said liquid distillation stream is directed in heat exchange relation with at least a portion of said expanded second stream to supply said further cooling thereto.

5. The improvement according to claims 1 or 2 wherein (a) at least a portion of said volatile residue gas fraction is directed in heat exchange relation with at least a portion of said expanded second stream to supply said further cooling thereto; and (b) a liquid distillation stream is withdrawn from said fractionation tower in substantially the same region of said fractionation tower as said mid-column feed point of said further cooled second stream, whereupon said liquid distillation stream is directed in heat exchange relation with at least a portion of said expanded second stream to supply said further cooling thereto.

6. The improvement according to claims 1 or 2 wherein said further cooling of at least a portion of said expanded second stream is accomplished within said fractionation tower by withdrawing a liquid distillation stream from said fractionation tower at a location above said mid-column feed point of said further cooled second stream, whereupon said liquid distillation stream is subcooled and thereafter supplied to said fractionation tower at an upper mid-column feed point above its withdrawal location.

7. The improvement according to claim 6 wherein at least a portion of said volatile residue gas fraction is directed in heat exchange relation with said liquid distillation stream to supply said cooling thereto.

* * * * *